US010434395B1

(12) United States Patent
Palardis

(10) Patent No.: US 10,434,395 B1
(45) Date of Patent: Oct. 8, 2019

(54) SYSTEMS AND METHODS OF ANCHORING A SUPPORT STRUCTURE FOR A BATTING BALL ON A CABLE

(71) Applicant: Charles Steven Palardis, Tampa, FL (US)

(72) Inventor: Charles Steven Palardis, Tampa, FL (US)

( * ) Notice: Subject to any disclaimer, the term of this patent is extended or adjusted under 35 U.S.C. 154(b) by 0 days.

(21) Appl. No.: 16/025,021

(22) Filed: Jul. 2, 2018

(51) Int. Cl.
*A63B 69/00* (2006.01)
*A63B 69/40* (2006.01)
*A63B 71/02* (2006.01)

(52) U.S. Cl.
CPC ..... *A63B 71/023* (2013.01); *A63B 69/0002* (2013.01); *A63B 69/0079* (2013.01); *A63B 2069/0008* (2013.01); *A63B 2071/024* (2013.01)

(58) Field of Classification Search
CPC ..... A63B 71/023; A63B 69/0002; A63B 69/00079; A63B 2069/0008; A63B 2071/024
USPC ..... 248/156, 354.1, 125.8, 507, 903; 473/422, 429, 430, 131, 139
See application file for complete search history.

(56) References Cited

U.S. PATENT DOCUMENTS

| | | | | | |
|---|---|---|---|---|---|
| 4,342,459 | A * | 8/1982 | Pretorius | A63B 69/0084 | 256/38 |
| 5,366,225 | A * | 11/1994 | Lazar | A63B 69/0079 | 473/147 |
| 5,467,978 | A * | 11/1995 | Paluch | A63B 69/0079 | 473/429 |
| 5,472,186 | A * | 12/1995 | Paulsen | A63B 69/0091 | 473/429 |
| 6,296,582 | B1 * | 10/2001 | Minniear | A63B 69/0002 | 473/422 |
| 8,784,249 | B2 * | 7/2014 | Motodohi | F15B 21/001 | 475/5 |
| 9,011,277 | B2 * | 4/2015 | Schell | A63B 69/0002 | 473/422 |
| 2007/0060418 | A1 * | 3/2007 | Arenas | A63B 69/0002 | 473/417 |

* cited by examiner

*Primary Examiner* — Tan Le
(74) *Attorney, Agent, or Firm* — Tiffany C. Miller; Inventions International Inc.

(57) ABSTRACT

A method of anchoring a support structure for a batting ball on a cable includes the steps of providing at least one batting ball on a batting ball cable having a first end located opposite a second end. A cord is provided having a first end located opposite a second end. An auger is provided and has a driven end connected to a threaded portion. The auger has a removable washer and a nut. An anchoring surface is provided. A first support structure having a plate and connected to an adjustable rod is provided. An anchoring member is provided. At least one portion of the anchoring member is connected to an anchoring surface. The anchoring member has at least one opening configured to receive the auger. The batting ball on a cable is suspended when said second end of the cable is connected to a second support structure.

12 Claims, 4 Drawing Sheets

SYSTEMS AND METHODS OF ANCHORING A SUPPORT STRUCTURE FOR A BATTING BALL ON A CABLE

BACKGROUND OF THE INVENTION

1. Field of the Invention

This invention relates, generally, to an anchoring system. More particularly, it relates to a system for anchoring a support structure for a batting ball on a cable.

2. Background Art

Conventional batting practice equipment such as a batting ball on a cable are connected to a mobile, free-standing support structure. When a user is hits a batting ball on a batting cable, the support structure that the batting ball cable is connected to may be tipped over or may be shifted by the force of a user's swing upon the batting ball. It is an important aspect of this invention for the tension of the batting cable to maintain its integrity during use. Therefore, there is a need for the support structure connected to the batting ball cable to be securely anchored to an anchoring surface, such as the playing field, so that movement of the support structure is eliminated during use.

SUMMARY OF THE INVENTION

The long-standing but heretofore unfulfilled need for a method of anchoring a support structure for a batting ball on a cable which also includes improvements that overcome the limitations of prior art baseball practice anchoring methods is now met by a new, useful, and non-obvious invention.

The novel method of anchoring a support structure for a batting ball on a cable includes the steps of providing at least one batting ball on a batting ball cable having a first end located opposite a second end. In the next step, a cord is provided having a first end located opposite a second end. An auger is provided and has a driven end connected to a threaded portion. The auger has a removable washer and a nut removably connected to the threaded portion of the auger. An anchoring surface is provided. It is within the scope of this invention for the anchoring surface to include but not be limited to, the ground, the floor, a playing field, or any substantially flat surface. In the next step, a first support structure is provided. The first support structure has a plate with a top surface and a bottom surface. The bottom surface of the plate is connected to an anchoring surface. The plate has at least one opening configured to receive the auger. The top surface of the plate has a shaft. The shaft has a central bore. The support structure has an adjustable rod connected to the central bore of the shaft. The support structure has a latching mechanism configured to orient the adjustable rod at a desired height.

In the next step of the novel method of anchoring a support structure for a batting ball on a cable, an anchoring member is provided. At least one portion of the anchoring member is connected to an anchoring surface. The anchoring member has at least one opening configured to receive the auger. A user aligns at least one opening of the anchoring member over at least one opening of the plate. A user then inserts the auger through at least one opening of the anchoring member and through at least one opening of the plate. At least a portion of the anchoring member overlays at least a portion of the plate. A user then drives the auger through the anchoring surface. The driven end of the auger protrudes from the opening of the anchoring member to expose the threaded portion of the auger. The user then places the washer over at least one opening of the anchoring member. The driven end of the auger receives the opening of the washer. The user tightens the nut on the threaded portion of the auger to secure the washer tightly against the anchoring member.

In the next step of the novel method of anchoring a support structure for a batting ball on a cable, the user connects the first end of the cord to the adjustable rod of the first support structure and connects the second end of the cord to the anchoring member. The user then connects the first end of the batting ball cable to the adjustable rod of the first support structure. At least one batting ball is suspended on the batting ball cable when the second end of said cable is connected to a second support structure.

In an alternate embodiment, the method of anchoring a support structure for a batting ball on a cable includes the step of providing an auger having a driven end adapted to be connected to a power tool. The auger can be driven into the ground with a power tool including, but not limited to, a drill or any driving mechanism. It is also within the scope of this invention for the auger to have a driven end adapted to be connected to a lever. A user can manually drive the auger into the ground when a lever is connected to the driven end of the auger.

In another alternate embodiment, the method of anchoring a support structure for a batting ball on a cable includes the step of providing an anchoring member having a stepped portion. The stepped portion of the anchoring member has at least one opening that receives the auger. The stepped portion of the anchoring member is positioned to overlay the plate and is connected to the top surface of the plate.

In yet another embodiment, the method of anchoring a support structure for a batting ball on a cable includes the step of providing an adjustable rod of the first support structure having a cord retaining structure. The cord retaining structure is located 180 degrees from the first end of the batting ball cable when the first end of the batting ball cable is connected to the adjustable rod. The cord retaining structure protrudes from the adjustable rod and has an opening. The opening of the cord retaining structure retains the first end of the cord.

In another embodiment, the method of anchoring a support structure for a batting ball on a cable includes the step of providing a second support structure. The second support structure has the same exact structural components as the first support structure. The second support structure has a plate. The plate has a top surface and a bottom surface. The bottom surface of the plate is connected to an anchoring surface. The plate has at least one opening receiving an auger. The top surface of the plate has a shaft. The shaft has a central bore. The second support structure has an adjustable rod connected to the central bore of the shaft. The second support structure has a latching mechanism configured to orient the adjustable rod at a desired height. It is also within the scope of this invention for the second support structure to be a fence.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
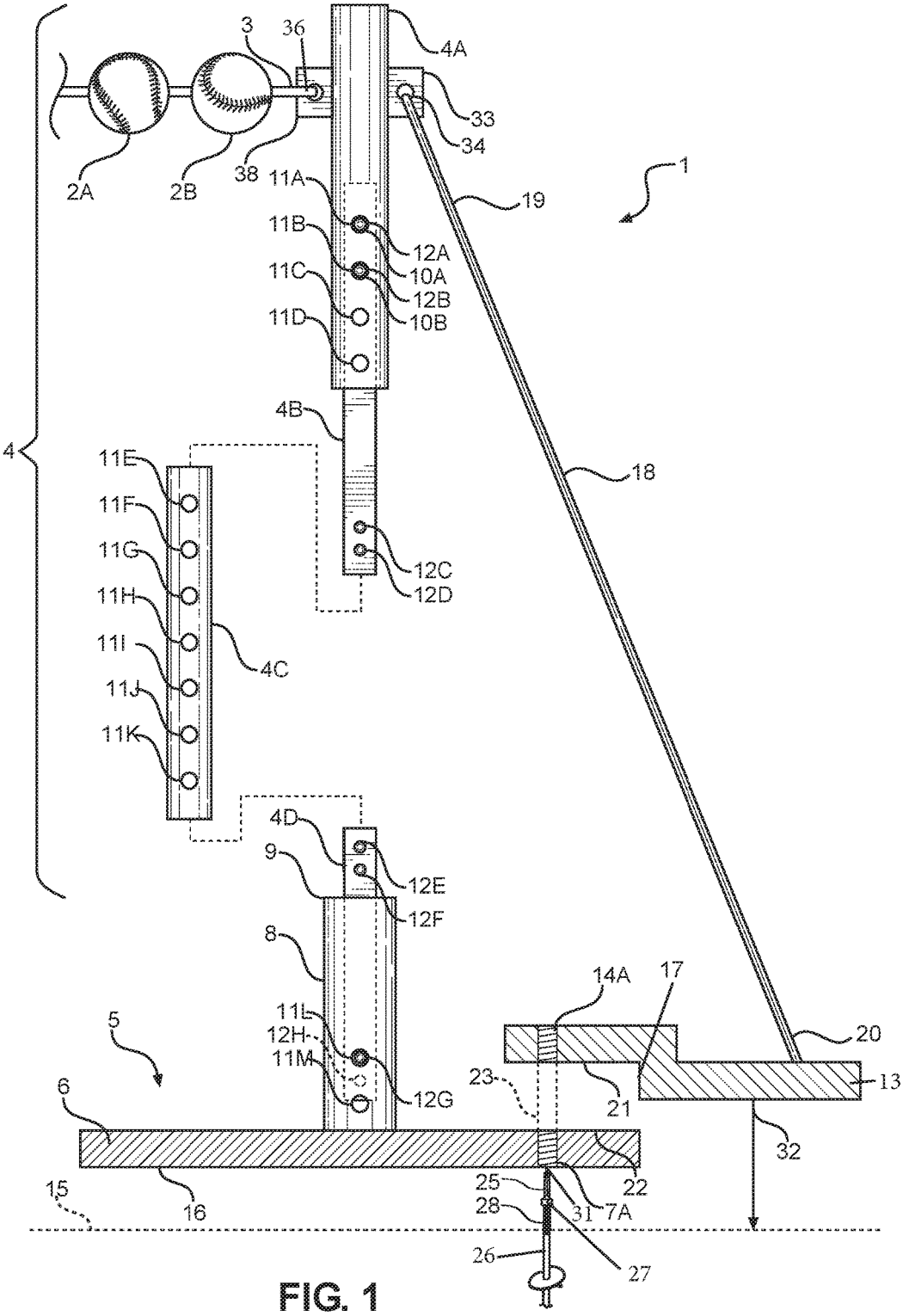
FIG. 1 is an exploded view of a plurality of the adjustable rod portions being in alignment with the shaft of a plate and the anchoring member having an opening in alignment with an opening of the plate.
Figure 2:
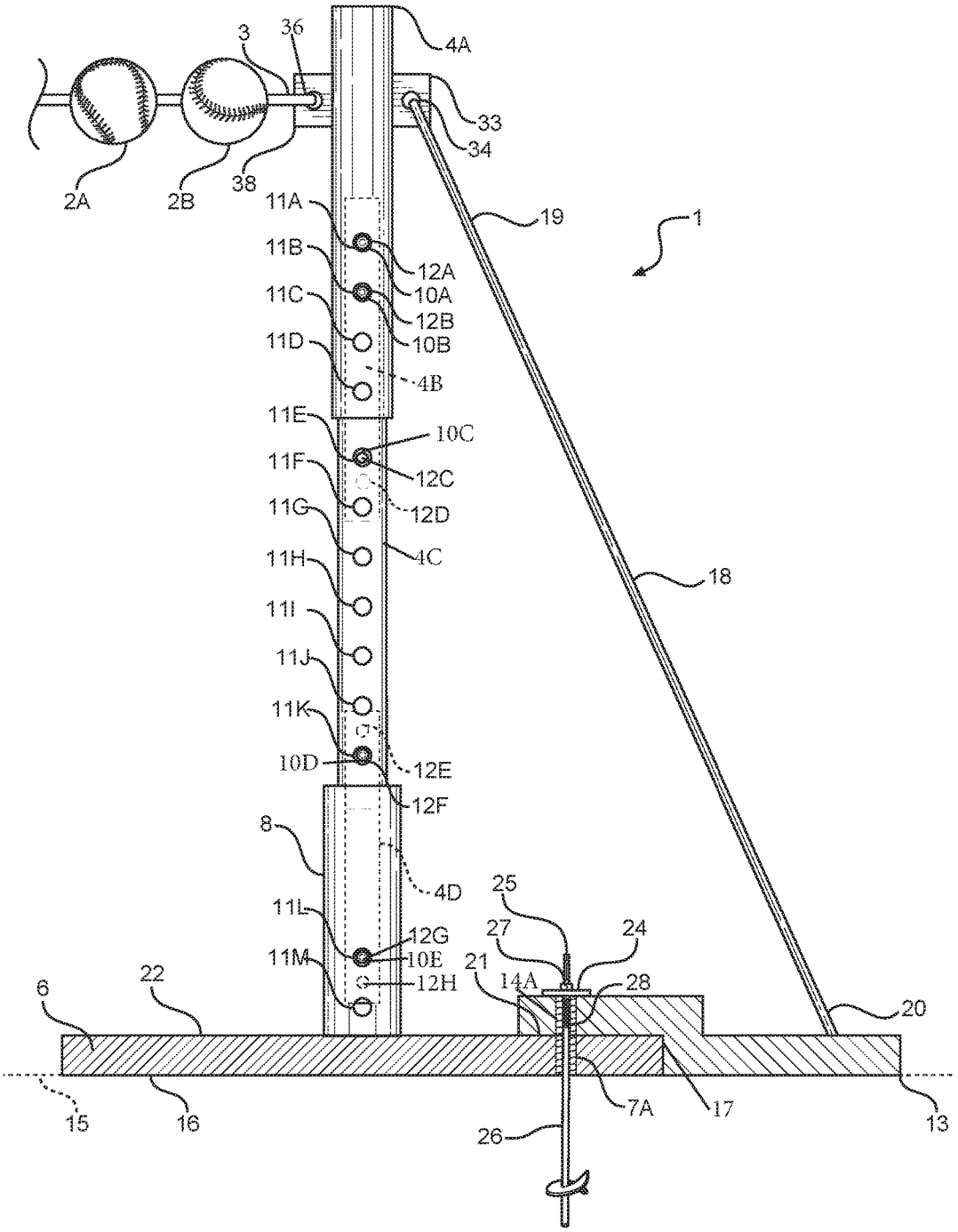
FIG. 2 is a perspective view of an auger positioned in alignment with an opening of the anchoring member and an opening of the plate of the support structure, being driven into the ground, and secured in place with a nut and washer.
Figure 5:
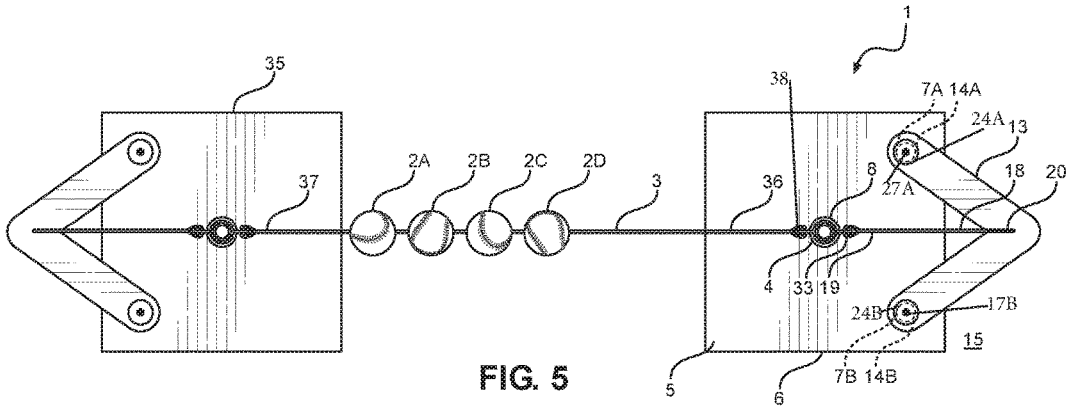

Referring now to FIGS. 1-2, anchoring system 1 includes the steps of providing batting ball 2A and 2B on batting ball cable 3. It is within the scope of this current invention for a single ball or for a plurality of batting balls to slidably traverse cable 3. Batting ball cable 3 has first end 36 located opposite second end 37 (FIG. 5). First end 36 of cable 3 is connected to rod 4A. Rod 4A can have a fastener including, but not limited to, an eyelet 38 (FIGS. 1-2), a snap, a magnet, a button, a clip, or a hook. It is also within the scope of this invention for cable 3 to be tied to eyelet 38. It is also within the scope of this invention for cable 3 to have a fastener connected to eyelet 38 of rod 4A. It is within the scope of this invention for cable 3 to be connected to rod 4A with a screw.

In the next step, FIGS. 1 and 2 illustrate anchoring system 1 having cord 18 provided. Cord 18 has first end 19 located opposite second end 20. Anchoring surface 15 is provided. First support structure 5 is provided. First support structure 5 has plate 6 with top plate surface 22 and bottom plate surface 16. Bottom surface 16 of plate 6 is connected to anchoring surface 15. Plate 6 has opening 7A (FIGS. 1, 2, and 5) and opening 7B (FIG. 5) configured to receive auger 26. Top surface 22 of plate 6 has shaft 8. Shaft 8 has central bore 9 configured to retain at least a portion of adjustable rod 4.

FIG. 1 shows adjustable rod 4. Adjustable rod 4 is adjustable because it is made of a plurality of rods including, but not limited to, rod 4A having openings 11A-11D, rod 4B having protruding structures 12A and 12B, rod 4C having openings 11E-11H, and rod 4D having protruding structures 12C-12D. These rods may have varying lengths to accommodate different attachments such as baseball 2A on cable 3 or even a volleyball net (not shown). It is within the scope of this invention for the rods to each have a plurality of openings 11 or a plurality of protrusions 12. When a protruding structure 12 is aligned and engaged with opening 11, the connection forms a latching mechanism 10. Protruding structure 12 is in communication with a resilient member (not shown) including, but not limited to, a spring. When protruding structure 12 is depressed, the resilient member is depressed which allows rod 4B and rod 4D to slidably traverse at least a portion of the length of the base 8, rod 4A, or rod 4C.

FIG. 1 illustrates first portion 4A of adjustable rod a having cord retaining structure 38. Cord retaining structure 38 has an opening configured to receive at least a portion of cord 3. Adjustable rod 4 has a first removable portion 4A having a plurality of openings 11A-11D. Adjustable rod 4 has second removable portion 4B having a first pair of protruding structures 12A-12B located on the top portion of second removable portion 4B of adjustable rod 4. Second removable portion 4B of adjustable rod 4 has a second pair of protruding structures 12C-12D located on the bottom portion of second removable portion 4B of adjustable rod 4. At least one protruding structure of first pair of protruding structures 12A-12B are configured to engage at least one opening 11A-11D of first portion 4A of adjustable rod 4. Adjustable rod 4 has third removable portion 4C having a plurality of openings 11E-11K. At least one protruding structure of second pair of protruding structures 12C-12D are configured to engage at least one opening 11E-11K of third portion 4C of said adjustable rod 4.

FIG. 1 further depicts adjustable rod 4 having fourth removable portion 4D having a third pair of protruding structures 12E-12F located on the top portion of fourth removable portion 4D of adjustable rod 4. Fourth removable portion 4D of adjustable rod 4 has a fourth pair of protruding structures 12G-12H located on the bottom portion of fourth removable portion 4D of adjustable rod 4. At least one protruding structure of third pair of protruding structures 12E-12F are configured to engage at least one opening 11E-11K of third portion 4C of adjustable rod 4. At least one protruding structure of fourth pair of protruding structures 12G-12H are configured to engage at least one opening 11L-11M of shaft 8 of first support structure 5.

FIGS. 1, 2, and 5 show first support structure 5 having adjustable rod 4 connected to central bore 9 of shaft 8. First support structure 5 has at least latching mechanism 10A and 10B configured to orient adjustable rod 4 at a desired height. Latching mechanism includes, but is not limited to, a depressible protrusion 12A and 12B that catches an opening 11A-11D.

Figure 3:
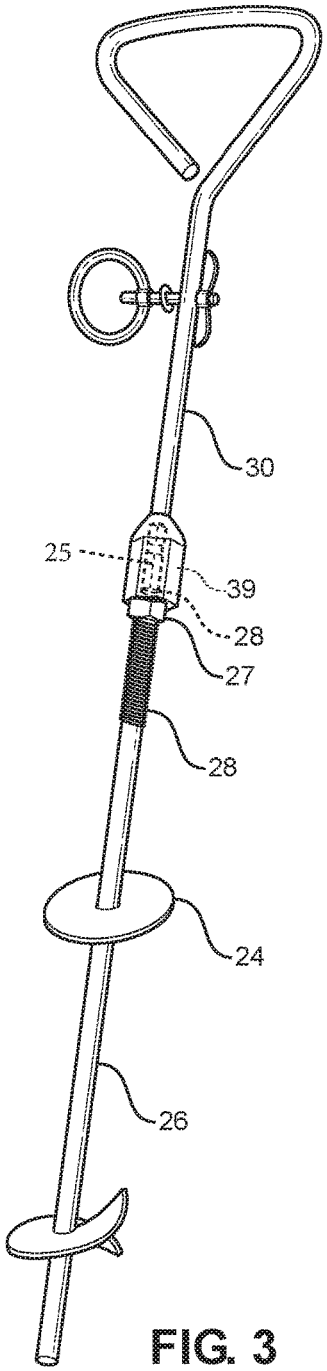
FIG. 3 is a perspective view of a lever having a coupler connected to the driven end of an auger having a nut and a washer connected thereto.
Figure 4:
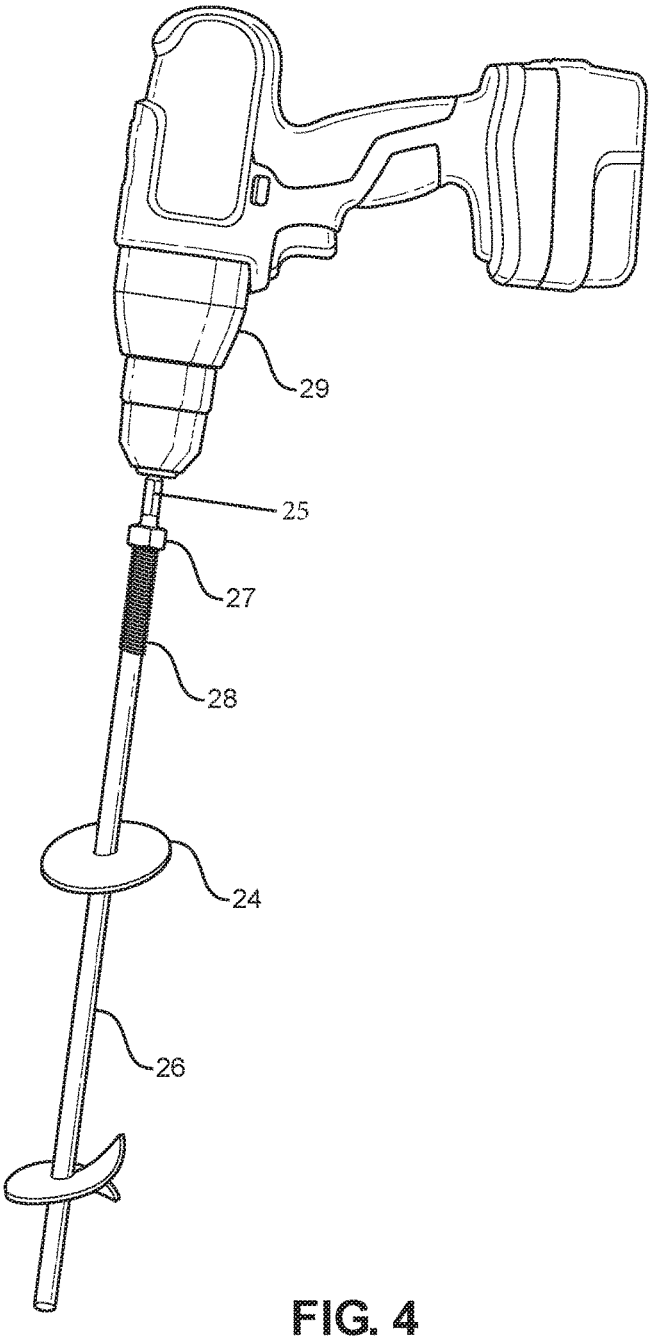
FIG. 4 is a perspective view of view of a power tool connected to the driven end of an auger having a nut and a washer connected thereto; and, FIG. 5 is a perspective view of a batting ball on a cable suspended between a first support structure and a second support structure each connected to an anchoring member by two augers.

FIGS. 1-4 illustrate auger 26 having driven end 25 connected to threaded portion 28. Auger 26 has a helical end. Auger 26 has removable washer 24 (FIGS. 2-4) and nut 27 (FIGS. 2-4) removably connected to threaded portion 28 of auger 26. FIG. 4 illustrates power tool 29 being a drill connected to driven end 25 of auger 26. FIGS. 3 and 4 depict lever 30 connected to driven end 25 of auger 26. Lever 30 is connected to coupler 39 (FIGS. 3-4). Coupler 39 can be rotated onto threaded portion 28 of auger 26 with lever 30 or a socket wrench (not shown). Coupler can be connected to lever or may be a separate piece. It is within the scope of this invention for nut 27 having an integrally formed serrated washer (not shown) and integrally formed coupler 39. In particular, the coupler 39 has an outer wall surface having a smaller diameter in size than nut 27, so there is a stepped portion due to the difference in size between the nut 27 and coupler 39. Nut 27 having an integrally formed serrated washer and integrally formed coupler 39 (not shown) has a central bore having an inner wall surface. The inner wall surface of the central bore is threaded. The threaded inner wall surface of the bore receives the threaded portion of auger 26.

FIGS. 1-2 illustrate anchoring member 13 being provided. At least one portion 32 of anchoring member 13 is connected to anchoring surface 15. Anchoring member 13 has opening 14A (FIGS. 1, 2, and 5) and opening 14B (FIG. 5) configured to receive 31 (FIG. 1) auger 26. A user aligns 23 (FIG. 1) opening 14A of anchoring member 13 over opening 7A of plate 6. A user then inserts auger 26 through opening 14A of anchoring member 13 and through opening 17A of plate 6. At least a portion, stepped portion 17 of anchoring member 13 overlays at least a portion of plate 6. Contact surface 21 of stepped portion 17 contacts top surface 22 of plate 6 when installed by a user. A user then drives auger 26 through anchoring surface 15. Driven end 25 (FIG. 2) of auger 26 protrudes from opening 14A of anchoring member 13 to expose threaded portion 28 of auger 26. The user then places removable washer 24 over opening 14A of anchoring member 13. Driven end 25 of auger 26 receives the opening of washer 24 (FIGS. 2, 3, and 4). The user tightens nut 27 (FIGS. 2, 3, and 4) on threaded portion 28 of auger 26 to secure washer 24 tightly against anchoring member 13.

FIGS. 1, 2, and 5 depict first end 19 of cord 18 being connected to adjustable rod 4 of first support structure 5 and second end 20 of cord 18 being connected to anchoring member 13. First end 36 of batting ball cable 3 is connected to adjustable rod 4 of first support structure 5. Batting balls 2A and 2B are suspended on batting ball cable 3 when second end 37 of batting ball cable 3 is connected to second support structure 35 (FIG. 5). Second support structure 35 has the same exact structural components as first support structure 5. Adjustable rod 4 of first support structure 5 has cord retaining structure 33. Cord retaining structure 33 is located 180 degrees from first end 36 of batting ball cable 3 when first end 36 of batting ball cable 3 is connected to adjustable rod 4. Cord retaining structure 33 protrudes from adjustable rod 4 and has opening 34 (FIGS. 1 and 2). Opening 34 of cord retaining structure 33 retains first end 19 of cord 18.

FIGS. 1 and 2 show anchoring member 13 having stepped portion 17. Stepped portion 17 of anchoring member 13 has opening 14A (FIGS. 1, 2, and 5) that receives an auger 26 and has opening 14B (FIG. 5) that receives a second auger (not shown). Stepped portion 17 of anchoring member 13 is positioned to overlay plate 6 and is connected to 21 top surface 22 of plate 6.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. A method of anchoring a support structure for a batting ball on a cable, comprising the steps of:

providing at least one batting ball on a batting ball cable having a first end located opposite a second end;

providing a cord having a first end located opposite a second end;

providing an auger having a driven end connected to a threaded portion, said auger having a washer removably connected thereto, said auger having a nut removably connected to said threaded portion of said auger;

providing an anchoring surface;

providing a first support structure, said first support structure having a plate, said plate having a top surface and a bottom surface, said bottom surface of said plate is connected to said anchoring surface, said plate having at least one opening configured to receive said auger, said top surface of said plate having a shaft, said shaft having a central bore, said first support structure having an adjustable rod connected to said central bore of said shaft, said support structure having a latching mechanism configured to orient said adjustable rod at a desired height;

providing an anchoring member, at least one portion of said anchoring member is connected to said anchoring surface, said anchoring member having at least one opening configured to receive said auger;

a user aligning said at least one opening of said anchoring member over said at least one opening of said plate;

said user inserting said auger through said at least one opening of said anchoring member and through said at least one opening of said plate, at least a portion of said anchoring member overlays at least a portion of said plate;

said user driving said auger through said anchoring surface;

said user placing said washer over said at least one opening of said anchoring member, said driven end of said auger receives said washer;

said user tightening said nut on said threaded portion of said auger to secure said washer against said anchoring member;

said user connecting said first end of said cord to said adjustable rod of said first support structure;

said user connecting said second end of said cord to said anchoring member; and, said user connecting said first end of said batting ball cable to said adjustable rod of said first support structure, whereby, said at least one batting ball is suspended on said batting ball cable when said second end of said cable is connected to a second support structure.

2. The method of anchoring a support structure for a batting ball on a cable of claim 1, further comprising the steps of: providing said auger having a driven end adapted to be connected to a power tool.

3. The method of anchoring a support structure for a batting ball on a cable of claim 1, further comprising the steps of: providing said auger having a driven end adapted to be connected to a lever.

4. The method of anchoring a support structure for a batting ball on a cable of claim 1, further comprising the steps of: providing said anchoring member having a stepped portion, said stepped portion having at least one opening receiving said auger, said stepped portion of said anchoring member is connected to said top surface of said plate.

5. The method of anchoring a support structure for a batting ball on a cable of claim 1, further comprising the steps of: providing said adjustable rod of said first support structure having a cord retaining structure, said cord retaining structure is located 180 degrees from said first end of said batting ball cable, said cord retaining structure has an opening, said opening of said cord retaining structure retains said first end of said cord.

6. The method of anchoring a support structure for a batting ball on a cable of claim 1, further comprising the steps of: providing a second support structure, said second support structure having a plate, said plate having a top surface and a bottom surface, said bottom surface of said plate is connected to said anchoring surface, said plate having at least one opening receiving an auger, said top surface of said plate having a shaft, said shaft having a central bore, said second support structure having an adjustable rod connected to said central bore of said shaft, said second support structure having a latching mechanism configured to orient said adjustable rod at a desired height.

7. The method of anchoring a support structure for a batting ball on a cable of claim 1, further comprising the steps of: providing a second support structure, said second support structure being a fence.

8. An anchoring support structure for a batting ball on a cable, comprising:

an auger having a driven end connected to a threaded portion, said auger having a washer removably connected thereto, said auger having a nut removably connected to said threaded portion of said auger;

a first support structure, said first support structure having a plate, said plate having a top surface and a bottom surface, said bottom surface of said plate is configured to connect to an anchoring surface, said plate having at least one opening configured to receive said auger, said top surface of said plate having a shaft, said shaft having a central bore, said shaft having a plurality of openings, said first support structure having an adjustable rod connected to said central bore of said shaft, said support structure having a latching mechanism configured to orient said adjustable rod at a desired height;

an anchoring member, at least one portion of said anchoring member is configured to connected to said anchoring surface, said anchoring member having at least one opening configured to receive said auger;

said at least one opening of said anchoring member is aligned over said at least one opening of said plate;

said threaded portion of said driven end of said auger is positioned through said at least one opening of said anchoring member and through said at least one opening of said plate when said auger is installed into said anchoring surface, at least a portion of said anchoring member overlays at least a portion of said plate;

said washer is oriented over said at least one opening of said anchoring member, said driven end of said auger receives said washer; and, a cord, said cord having a first end located opposite a second end, said first end of said cord is connected to said adjustable rod of said first support structure, said second end of said cord is connected to said anchoring member.

9. The anchoring support member of claim 8, further comprising at least one batting ball on a batting ball cable, said batting ball cable having a first end located opposite a second end, said first end of said batting ball cable is connected to said adjustable rod of said first support structure, whereby, said at least one batting ball is suspended on said batting ball cable when said second end of said cable is connected to a second support structure.

10. The anchoring support member of claim 8, further comprising said adjustable rod having a first removable portion having a plurality of openings, said first portion of said adjustable rod having at least one cord retaining structure, said at least one cord retaining structure has an opening configured to receive at least a portion of said cord, said adjustable rod having a second removable portion, said second removable portion of said adjustable rod having a first pair of protruding structures located on the top portion of said second removable portion of said adjustable rod, said second removable portion of said adjustable rod having a second pair of protruding structures located on the bottom portion of said second removable portion of said adjustable rod, at least one protruding structure of said first pair of protruding structures are configured to engage at least one opening of said first portion of said adjustable rod, said adjustable rod having a third removable portion having a plurality of openings, at least one protruding structure of said second pair of protruding structures are configured to engage at least one opening of said third portion of said adjustable rod, said adjustable rod having a fourth removable portion, said fourth removable portion of said adjustable rod having a third pair of protruding structures located on the top portion of said fourth removable portion of said adjustable rod, said fourth removable portion of said adjustable rod having a fourth pair of protruding structures located on the bottom portion of said fourth removable portion of said adjustable rod, at least one protruding structure of said third pair of protruding structures are configured to engage at least one opening of said third portion of said adjustable rod, at least one protruding structure of said fourth pair of protruding structures are configured to engage at least one opening of said shaft of said first support structure.

11. The anchoring support member of claim 10, further comprising said first portion of said adjustable rod having an eyelet, said eyelet having an opening configured to receive at least a portion of a batting ball cable.

12. The anchoring support member of claim 8, further comprising said nut having an integrally formed serrated washer, said nut is connected to a coupler, said coupler having an outer wall surface having a smaller diameter in size than said nut.

* * * * *